US012392573B2

(12) United States Patent
Palanques-Fleck et al.

(10) Patent No.: US 12,392,573 B2
(45) Date of Patent: Aug. 19, 2025

(54) HAND-HELD GUN

(71) Applicants: Raphael Palanques-Fleck, Landshut (DE); Domenico Miranda, Sulz a. Neckar (DE); Hans-Peter Bantle, Dunningen (DE)

(72) Inventors: Raphael Palanques-Fleck, Landshut (DE); Domenico Miranda, Sulz a. Neckar (DE); Hans-Peter Bantle, Dunningen (DE); Jannick Maier, Dietingen (DE); Horst Silvio Joho, Epfendorf (DE)

(73) Assignees: Raphael Palanques-Fleck, Landshut (DE); Domenico Miranda, Sulz A. Neckar (DE); Hans-Peter Bantle, Dunningen (DE)

( * ) Notice: Subject to any disclaimer, the term of this patent is extended or adjusted under 35 U.S.C. 154(b) by 0 days.

(21) Appl. No.: 18/413,780

(22) Filed: Jan. 16, 2024

(65) Prior Publication Data

US 2024/0240906 A1 Jul. 18, 2024

(30) Foreign Application Priority Data

Jan. 16, 2023 (DE) ..... 10 2023 100 897.8

(51) Int. Cl.
*F41A 25/10* (2006.01)

(52) U.S. Cl.
CPC ..... *F41A 25/10* (2013.01)

(58) Field of Classification Search
CPC ..... F41A 25/10; F41A 25/12; F41A 25/14; F41A 25/18

(Continued)

(56) References Cited

U.S. PATENT DOCUMENTS 1,563,675 A * 12/1925 Tansley ..... F41A 17/38 89/196
3,901,125 A * 8/1975 Raville ..... F41A 3/86 89/196

(Continued)

FOREIGN PATENT DOCUMENTS

DE 6930299 C1 6/1969
DE 4341131 C1 2/1995

(Continued)

OTHER PUBLICATIONS

German Patent and Trademark Office; Request for Examination in corresponding German patent application No. 102023100897.8, dated Aug. 10, 2023; 18 pages.

(Continued)

*Primary Examiner* — John Cooper
(74) *Attorney, Agent, or Firm* — Fitch, Even, Tabin & Flannery LLP

(57) ABSTRACT

A hand-held gun having a grip part and a breech part movably supported in a longitudinal direction thereon is disclosed. A breech spring arrangement urges breech part in its initial position relative to grip part. For this purpose, breech spring arrangement is supported between the breech part and grip part. Starting from the initial position, breech part can move against the closing force of breech spring arrangement into an abutment position in which it abuts against a buffer body. Starting from the abutment position, breech part can be moved under elastic compression of buffer body in the longitudinal direction into a retracted position. In the movement area between the abutment position and the retracted position, a compression force is applied by the compressed buffer body in addition to the closing force of the breech spring arrangement between the grip part and the breech part.

15 Claims, 9 Drawing Sheets

(58) Field of Classification Search
USPC ..... 89/44.01, 44.02
See application file for complete search history.

(56) References Cited

U.S. PATENT DOCUMENTS 4,031,808 A * 6/1977 Raville ..... F41A 3/86 89/163
4,088,057 A * 5/1978 Nasypany ..... F41A 21/28 42/1.06
4,150,819 A * 4/1979 Taylor ..... F16F 13/00 89/43.01
4,522,107 A * 6/1985 Woodcock ..... F41A 3/86 89/196
5,060,555 A * 10/1991 Sater ..... F41A 3/78 89/196
8,752,474 B2 * 6/2014 Vanek ..... F41A 5/06 89/198
8,939,059 B2 * 1/2015 Coffman, II ..... F41A 3/80 89/44.01
10,302,380 B2 * 5/2019 Hangen ..... F41A 3/56
10,928,153 B2 * 2/2021 Hangen ..... F41A 3/56
12,196,515 B1 * 1/2025 Mantas ..... F41A 25/12
2005/0247187 A1 * 11/2005 McGarry ..... F41A 5/04 89/198
2012/0085225 A1 * 4/2012 Vanek ..... F41A 5/06 89/163
2014/0216243 A1 * 8/2014 Coffman, II ..... F41A 3/10 89/196

FOREIGN PATENT DOCUMENTS

DE 19722806 C1 9/1998
DE 102016009047 B3 1/2008
DE 102007003180 A1 7/2008
DE 102016009185 A1 2/2018
DE 102018129083 A1 5/2019

OTHER PUBLICATIONS

German Patent and Trademark Office; Decision to Grant in corresponding German patent application No. 102023100897.8, dated Dec. 12, 2023; 16 pages.

* cited by examiner

HAND-HELD GUN

CROSS REFERENCE TO RELATED APPLICATION

This patent application claims the benefit of German Patent Application No. 10 2023 100 897.8, filed Jan. 16, 2023.

TECHNICAL FIELD

The invention refers to a hand-held gun. The hand-held gun can be a long weapon or a short weapon or handgun, particularly a pistol.

Background

In hand-held guns, particularly pistols in a very compact construction, recoil forces can occur during firing, which can affect the marksmanship of the shooter. This is all the more so for hand-held guns that use ammunition with high penetrating power or comparable large caliber. Therefore, it is desirable to improve the construction of the hand-held gun that affects the marksmanship as little as possible.

DE 10 2007 003 180 A1 describes a hand-held gun configured as grenade weapon comprising a barrel assembly and a frame assembly. Between the barrel assembly and the frame assembly a recoil damping arrangement is arranged. The recoil damping arrangement is supported on one hand on the barrel assembly and on the other hand on the frame assembly and comprises a guide sleeve for a firing pin. The guide sleeve is coaxially surrounded by a damping spring of the damping arrangement. The damping spring can be configured as elastomer spring.

DE 10 2016 009 047 B3 and DE 10 2016 009 185 A1 comprise hand-held guns having hydraulic damping devices in which a hydraulic liquid is displaced out of a cylinder chamber into a balance chamber for damping a recoil.

A rifle having a damping plate between a barrel and a shaft is described in DE 10 2018 129 083 A1.

A self-loading pistol having a chamber spring arrangement enclosed by an elastomer sleeve is disclosed in DE 197 22 806 C1. When firing the chamber spring arrangement and the elastomer sleeve are compressed by a slide of the self-loading pistol. Due to compression of the elastomer sleeve, it gets into friction contact with the chamber spring arrangement on one hand and with an inner wall bore on the grip of the self-loading pistol on the other hand. Via this friction contact the forces transmitted by the slide can be supported extensively on the grip of the self-loading pistol.

SUMMARY

Starting from the known prior art, it can be one object of the invention to improve damping of recoil forces during firing and concurrently to allow a compact configuration of the hand-held gun.

This object is solved by means of the features of a hand-held gun as described herein.

The handgun according to the present invention can be a long weapon or a short weapon, preferably a pistol. It can be a fully automatic or a semi-automatic hand-held gun.

The hand-held gun has a grip part, which can comprise a grip for holding the hand-held gun. On the grip part a breech part is movably supported in a longitudinal direction, e.g. on a holding part of the grip part. The breech part can also be denoted as slide. It comprises a closing element that serves to close a chamber in an initial position. In a retracted position, the breech part is distanced from the chamber in order to allow the removal of a cartridge case from the chamber and the supply of a cartridge into the chamber. By means of a breech spring arrangement acting between the grip part and the breech part, the breech part is urged or pretensioned into the initial position.

An elastically deformable buffer body is arranged on the grip part. In the initial position of the breech part a longitudinal distance exists in longitudinal direction between the buffer body and the breech part, particularly a support part of the breech part. If during firing the breech part moves backward in longitudinal direction, this movement results first in a compression of the breech spring arrangement, the spring force of which counteracts the movement of the breech part. If the breech part has overcome the longitudinal distance to the buffer body, it gets into abutment with the buffer body. The further backward movement of the breech part results in an elastic compression of the buffer body, while the breech spring arrangement is further compressed. In this back movement section of the breech part relative to the grip part, the breech spring arrangement and the buffer body are connected in parallel to one another so-to-speak. This back movement section is limited by the retracted position of the breech part or adjoins the retracted position. In the retracted position the breech part is in the furthest backward moved position relative to the grip part.

The recoil of the breech part is thus damped in a first movement phase of the breech part exclusively by the breech spring arrangement and during an adjoining additional movement phase by means of the breech spring arrangement as well as the damping element or buffer body. It has shown that the maximum occurring recoil force can be remarkably reduced thereby, preferably at least about 40% to 50% and further preferably about at least 60% to 70% and particularly about approximately 80% compared with a hand-held gun of similar construction, however, without buffer body. Due to the dimensioning and material selection of the buffer body, the desired damping can be very simply reached adapted to the hand-held gun.

Preferably the buffer body is releasably attached on the grip part, e.g. in a force-fit and/or form-fit manner. The buffer body can be non-destructively exchangeably arranged on the grip part.

Preferably the buffer body is a uniformly handable part that can consist from one or multiple materials.

It is advantageous, if a frame part is arranged on the grip part, wherein the buffer body is supported in longitudinal direction on the frame part, if it is compressed by means of the breech part moving into the open position. Preferably the buffer body is in continuous contact with the frame part of the grip part. In an embodiment the buffer body is directly arranged in front of the frame part in longitudinal direction on the grip part and thereby continuously in contact with the frame part. The buffer body can be secured by means of the frame part against an undesired movement orthogonal to the longitudinal direction.

In a preferred embodiment the buffer body has a stop plate for the breech part on its face side facing the breech part in longitudinal direction. The buffer body has in addition an elastomer element, which is deformable by forces applied by the breech part, wherein the elastomer element is arranged behind the stop plate and is supported on the back side, opposite the stop plate, on the grip part and/or frame part. The stop plate is rigid for the forces applied by the breech part, i.e. it does not elastically deform or only insignificantly compared with the elastic deformation of the elastomer element.

The stop plate can consist of metal or a metallic alloy, for example.

The elastomer element is preferably a monolithic body of natural rubber and/or synthetic rubber and/or another suitable elastomer material. For example, styrene-butadiene rubber (SBR) or a polyurethane material or ethylene-propylene-diene rubber (EPDM) or silicone rubber can be considered as elastomer material. In general, synthetic rubber of an arbitrary group (e.g. R, M, O, U, Q or T) can be used.

Preferably the buffer body consists exclusively from one single stop plate and one single monolithic elastomer element. The stop plate and the elastomer element consist of different materials.

It is advantageous, if the buffer body comprises a longitudinal opening, which particularly extends entirely through the buffer body in longitudinal direction. The breech spring arrangement can extend in longitudinal direction through the longitudinal opening. The longitudinal opening can be surrounded by the buffer body in circumferential direction, so that the longitudinal opening is configured as through-hole. Preferably the longitudinal opening is open on one side orthogonal to the longitudinal direction, e.g. toward the top. In this configuration the buffer body has a U-shaped form with view in longitudinal direction or in a cross-sectional plane, which is orientated orthogonal to the longitudinal direction. The end surfaces of the buffer body facing upwards are preferably curved concavely or otherwise deepened or recessed, so that a clearance is created toward a virtual reference plane brought into contact from the top. Starting from a central area of the buffer body in longitudinal direction its height can increase toward the front and toward the back. The created clearance is available for displacing material of the elastomer element during compression of the buffer body. This configuration avoids that the compressed and thus deformed buffer body or the compressed and deformed elastomer element blocks or hinders the movement of a movably supported part, particularly the movement of the breech part.

The breech spring arrangement can be supported on the grip part directly or indirectly via the frame part. The other end of the breech spring arrangement is supported on the breech part, preferably on a front end of the breech part. Preferably the breech spring arrangement is compressed in the initial position as well as in the retracted position of the breech part.

In a preferred embodiment the breech spring arrangement or at least a component thereof serves as end stop that limits the maximum travel path of the breech part from its initial position into its retracted position and thus defines the retracted position. The breech spring arrangement comprises at least one breech spring, which can be particularly configured as helical spring. In the retracted position directly adjacent windings of the breech spring or one of the provided breech springs of the breech spring arrangement can abut against one another and can block a further compression of the breech spring arrangement in longitudinal direction. The completely compressed breech spring can be supported thereby directly or indirectly on the grip part or on the frame part in a rigid manner and in doing so, can block a further movement of the breech part in backward direction relative to the grip part. In this manner the retracted position can be defined. In the retracted position of the breech part the buffer body is maximally compressed. An exceeding elastic compression of the buffer body in longitudinal direction is avoided in this configuration by means of the breech spring arrangement.

In addition, the hand-held gun can comprise a holding device by means of which a form-fit and/or force-fit connection between the buffer body and the grip piece can be established. Particularly, the holding device is configured to limit or avoid an upward relative movement of the buffer body relative to the grip part.

The holding device can comprise at least one safety section or safety projection extending in longitudinal direction over a holding section of the buffer body. The safety section or safety projection can be arranged on the grip part and/or on the frame part and/or on the breech part and can be a monolithic component of the grip part or the frame part or the breech part. A holding section of the buffer body is assigned to each provided safety section or safety projection, extending over the assigned holding section.

If at least one safety section or safety projection is provided on the grip part and/or the frame part, it can abut in each position of the breech part on the respectively assigned holding section of the buffer body. At least one additionally or alternatively provided safety section or safety projection on the breech part can only abut against the respectively assigned holding section of the buffer body, if the breech part is not in its initial position and has particularly sufficiently approached the retracted position, e.g. has overcome the longitudinal distance to the buffer body and gets into contact with the latter (abutment position).

It is in addition advantageous, if the buffer body comprises at least one cavity. In the embodiment the at least one cavity is arranged in the elastically deformable component of the buffer body, particularly the elastomer element. An optionally provided stop plate can be arranged with distance to the at least one cavity in longitudinal direction. The at least one cavity forms a clearance in longitudinal direction with the buffer body being in the non-compressed initial condition. The clearance is free of solid materials and open to the surrounding atmosphere. The at least one cavity or clearance is thus filled with the fluid (particularly air) present in the surrounding atmosphere. If the hand-held gun is immersed in a liquid, the at least one cavity can fill with this liquid—at least until the hand-held gun is again removed from the liquid and the liquid can drain.

The at least one cavity is configured to adjust the compression-path-dependent compression force of the buffer body, which the buffer body applies during compression between the grip part and the breech part. By means of the number of cavities and/or their depth orthogonal to the longitudinal direction and/or their width parallel to the longitudinal direction, the compression-path-dependent elastic compression force can be adjusted very precisely. In addition, due to the at least one cavity, undesired temperature-dependent changes of the compression-path-dependent elastic compression force can be avoided. Thus, a temperature compensation can be achieved.

In a preferred embodiment the at least one cavity extends parallel to a transverse plane that is orientated orthogonal to the longitudinal direction. The at least one cavity can extend along an inner side or along an outer side of the buffer body and particularly the elastomer element. The at least one cavity can be open to the outer side or to the inner side of the buffer body. The inner side can thereby adjoin or limit the longitudinal opening extending through the buffer body while the outer side of the buffer body abuts against the grip part at least partly.

It is advantageous, if the buffer body comprises multiple cavities arranged with distance to one another in longitudinal direction. The cavities can form one single group or multiple groups, which are preferably identically configured. Particularly, these cavities can be alternatingly open toward the inner side and the outer side, at least in one common group or related to multiple groups. In doing so, a kind of accordion-shaped profile or bellows profile can result for the buffer body.

The elastomer element of the buffer body can comprise a longitudinal section having a predefined form and/or geometry. This longitudinal section can be provided exactly once between the stop plate and the back surface of the buffer body. Alternatively, this longitudinal section can be arranged multiple times adjoining one another in longitudinal direction between the stop plate and the back surface of the buffer body and form the elastomer element.

Each cavity can have a groove-like shape, i.e. two flanks opposed to one another in longitudinal direction in the non-compressed initial condition of the buffer body, wherein the flanks are connected with each other by means of a groove bottom. The flanks and the groove bottom are formed by the material of the buffer body. On the side opposite the groove bottom, the cavity is open toward the environment.

BRIEF DESCRIPTION OF THE DRAWINGS

Advantageous embodiments of the invention are derived from the dependent claims, the description and the drawings. In the following preferred embodiments of the invention are discussed in detail based on the attached drawing. The drawing shows:

DETAILED DESCRIPTION

Figure 1:
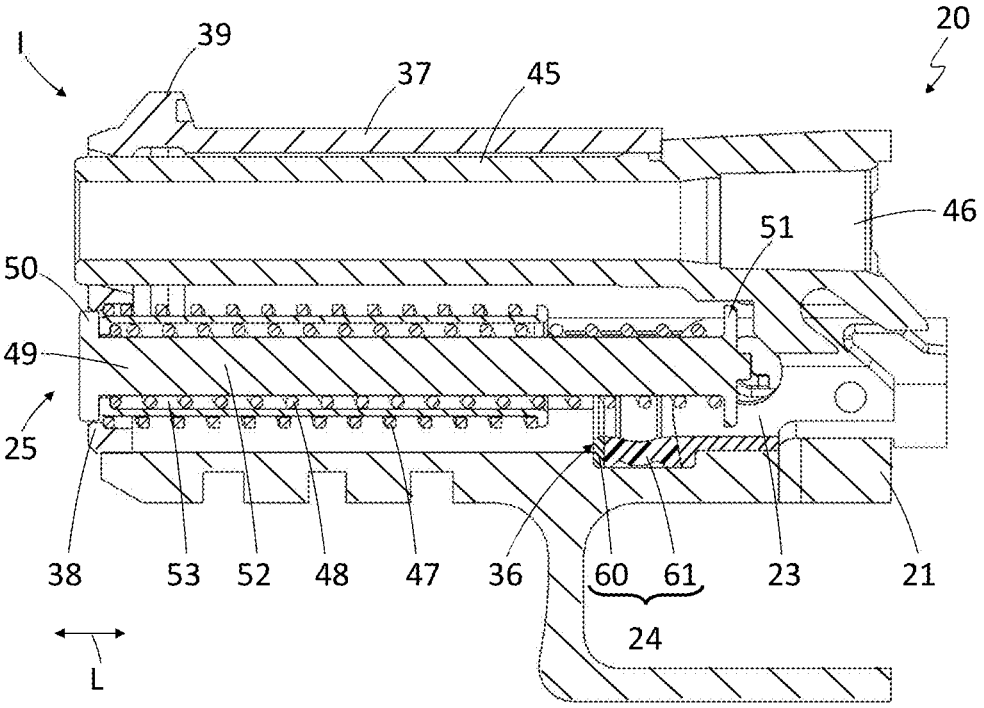
FIG. 1 a partial illustration of an embodiment of a hand-held gun in a longitudinal section, FIG. 2 a perspective partial illustration of a grip part, a buffer body and a frame part in an explosion illustration, FIG. 3 a partial illustration of the grip part and as well as of the buffer element of FIG. 2 in a top view onto the grip part, FIG. 4 a partial illustration of the grip part and an illustration of the buffer element of FIGS. 2 and 3 in a top view, FIG. 5 a perspective illustration and part of a breech part of the hand-held gun of FIG. 1, FIG. 6 the grip part and the buffer element of FIGS. 2-4 in a perspective partial illustration, FIG. 7 the breech part, the grip part and the buffer element in a partial illustration in side view, FIGS. 8 and 9 the embodiment of the hand-held gun of FIG. 1 in different conditions after firing, FIG. 10 the hysteresis of the buffer element during compression and release in a schematic diagram, FIG. 11 the acceleration acting on the grip part of the hand-held gun dependent from the time in a schematic illustration in the embodiment of the hand-held gun according to the present invention as well as according to a common hand-held gun.

In FIG. 1 a longitudinal section of an embodiment of a hand-held gun 20 is depicted in a partial illustration. The embodiment is a short weapon, particularly a fully or semi-automatic short weapon, and a pistol according to the example. In modification to this the hand-held gun 20 could also be a long weapon.

The hand-held gun 20 has a grip part 21 comprising a not illustrated grip by means of which the shooter can grip the hand-held gun 20. The grip part 21 has, in addition, a holding part 22 (FIGS. 2 and 3) for holding of additional components of the hand-held gun 20, particularly a frame part 23, a buffer body 24 as well as a breech spring arrangement 25. The holding part 22 is bowl or trough-shaped and open to the top and to the front, as particularly apparent from FIGS. 2 and 3. The holding part 22 has two side walls 26 that are opposed to one another with distance in a transverse direction Q and that extend in a longitudinal direction L. The two side walls 26 of holding part 22 limit a holding space 27 of holding part 22. A bottom 29 of holding part 22 connects the two side walls 26 and limits the holding space 27 downwardly.

Preferably buffer body 24 is supported in a tool-free releasable manner on frame part 23 and/or grip part 21, particularly exclusively in a force-fit and/or form-fit manner.

On the grip part 21 a non-illustrated magazine tunnel can be provided for locating a magazine therein. The magazine tunnel can be, e.g. inside the grip of grip part 21.

In the present application the expression "top", "bottom", "front" and "back" denote directions in which the hand-held gun is usually held during shooting. Thereby the shooting direction is toward the front. The holding part 22 of grip part 21 is in this position on top of a non-illustrated grip of grip part 21.

Figure 2:
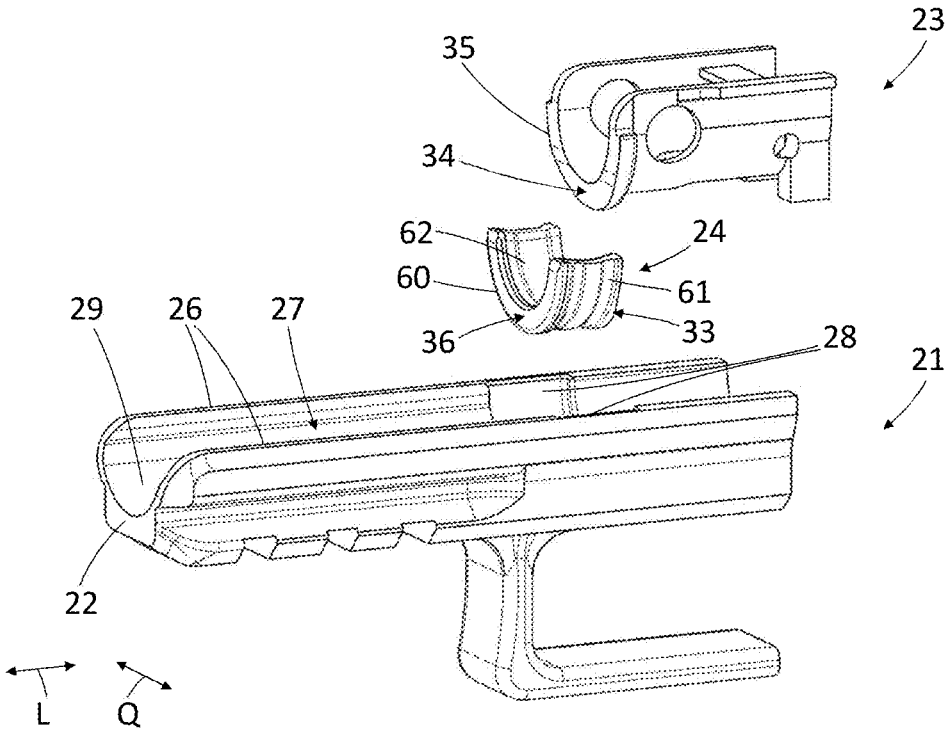
Figure 3:
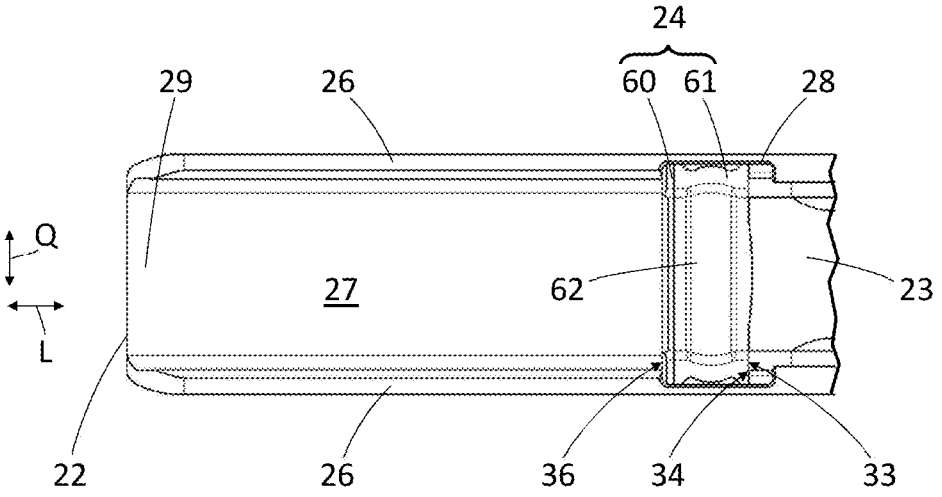

As particularly apparent from FIGS. 2 and 3, buffer body 24 and frame part 23 are arranged inside holding space 27 and are held there in a form-fit and/or force-fit manner. In the embodiment a groove-shaped holding depression 28 is provided in the holding part 22 for this purpose, wherein the holding depression 28 is open toward the holding space 27 and expands the holding space 27 in this area. In the embodiment holding depression 28 extends in the side walls 26 as well as optionally additionally in the bottom 29 of holding part 22 connecting the side walls. The holding depression 28 extends completely along the side walls 26 toward the top, so that the buffer body 24 and the frame part 23 can be inserted from the top into the holding space 27 and can thereby at least partly engage holding depression 28 in order to create a form-fit connection (compare FIGS. 2 and 3).

As particularly apparent from FIG. 3, in the embodiment, buffer body 24 is arranged engaging into the holding depression 28 along its entire length. Contrary to this, frame part 23 only extends at a front end into the holding depression 28. With view in longitudinal direction L, holding depression 28 is slightly longer than buffer body 24 in an installed initial condition in which it is not or only partly or slightly compressed in longitudinal direction L. If buffer body 24 is slightly compressed in longitudinal direction L in its installed initial condition, it can be arranged without play in longitudinal direction L between frame part 23 and the front end of holding depression 28 on holding part 22. In its installed initial condition buffer body 24 can be only slightly compressed in longitudinal direction L compared to its completely non-compressed condition and particularly about less than 10% and further preferably less than 5% relative to its completely non-compressed length, in order to arrange it without play in longitudinal direction L between the front end of holding depression 28 and frame part 23.

The buffer body 24 is illustrated in more detail in FIGS. 4, 6, 7 and 12-16 and 18. On its backside facing the frame part 23 it has a back surface 33, which abuts against an abutment surface 34 of frame part 23 in the installed initial condition. In longitudinal direction L buffer body 24 is thus supported toward the back on frame part 23.

In order to avoid a relative movement between grip part 21 and frame part 23 in longitudinal direction L toward the back, frame part 23 comprises a flange-type front part 35, which is configured to engage into holding depression 28 of holding part 22 and thus to establish a form-fit connection with grip part 21. On the front part 35 of frame part 23, abutment surface 34 for buffer body 24 and particularly the back surface 33 thereof is provided. According to the example, the front part 35 is monolithic component of frame part 23. In the embodiment front part 35 has a shape that is angled multiple times and/or curved in an arc-shaped manner around an axis extending parallel to the longitudinal direction L and is approximately U-shaped according to the example.

The buffer body 24 has a stop surface 36 for a breech part 37 of the hand-held gun 20 on its front side, which is opposite the back surface 33 in longitudinal direction L. The breech part 37 is movably supported in longitudinal direction L on the grip part 21. The breech part 37 can also be denoted as slide.

In the embodiment a support part 38 is provided on breech part 37, which can be monolithic component of breech part 37. The support part 38 projects from the bottom side of the breech part 37 downwardly according to the example. In the illustrated embodiment the support part 38 is arranged in the area of the front end of breech part 37 on which also a front side 39 of an aiming device can be present. The support part 38 is configured to engage into the holding space 27 and to move in the front section of holding space 27 holding space 27 in front of the frame part 23 or the buffer body 24 in longitudinal direction L when breech part 37 moves relative to the grip part 21 or the frame part 23—for example for manual loading of the hand-held gun 20 or for fully automatic or semi-automatic loading after firing.

In the embodiment support part 38 is round and particularly ring-shaped. On its back side it has a surface, which is here denoted as counter-stop surface 40, facing the buffer body 24 and the stop surface 36 thereof. The counter-stop surface 40 is configured to get into contact with stop surface 36 in order to elastically compress buffer body 24, which will be explained in detail in the following.

Figure 8:
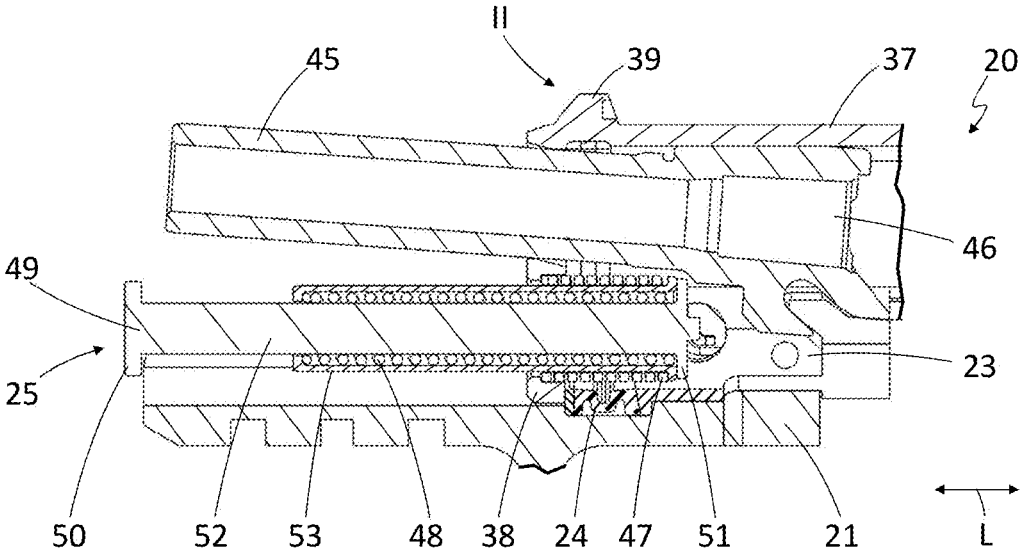
Figure 9:
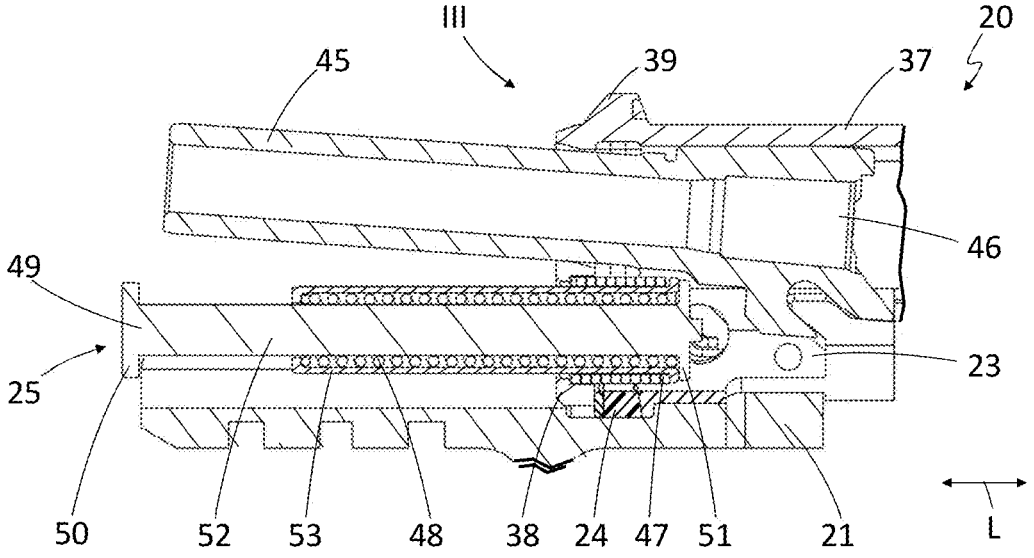

The breech spring arrangement 25 is configured to urge breech part 37 relative to grip part 21 in an initial position I, which is illustrated in FIG. 1. In the initial position I, a longitudinal distance is present in longitudinal direction L between stop surface 36 of buffer body 24 and counter-stop surface 40 of breech part 37 and, according to the example, the support part 38. Starting from the initial position I, breech part 37 can be manually, or due to firing, moved backwards in longitudinal direction L relative to grip part 21. Thereby first the longitudinal distance is overcome until the abutment position II is reached in which stop surface 36 and counter-stop surface 40 get into contact (FIG. 8). During a continued backward movement of breech part 37 it is moved from the abutment position II back to a retracted position III in which the relative movement of breech part 37 in the backward direction stops (FIG. 9).

A barrel 45 (FIGS. 1, 8 and 9) is also part of the hand-held gun 20. A chamber 46 is present on the barrel 45. In the initial position I a closing element of breech part 37, which is not illustrated in detail, closes chamber 46 in backward direction. During ignition of the cartridge when firing, breech part 37 is accelerated backwards in longitudinal direction L relative to grip part 21 and is moved out of the initial position I back into the retracted position III.

In the embodiment breech spring arrangement 25 has at least one breech spring and according to the example an outer breech spring 47 as well as an inner breech spring 48. The at least one breech spring 47, 48 surrounds a guide rod 49 of breech spring arrangement 25. The guide rod 49 can be a massive body or a hollow body. On its front end, guide rod 49 forms a front stop 50 and forms a back stop 51 on its opposite back end. Between the front stop 50 and back stop 51, guide rod 49 comprises a guide section 52, which is surrounded by the at least one breech spring, according to the example the outer breech spring 47 and the inner breech spring 48. The support part 38 surrounds the guide section 52 of guide rod 49. With view in longitudinal direction L the at least one breech spring 47, 48 is supported on one side on support part 38 and on the other side indirectly on the grip part 21 via back stop 51 and frame part 23. In the initial position I, support part 38 abuts against front stop 50 according to the example.

The guide rod 49 is supported with its back end, in the area of the back stop 51, indirectly or directly on grip part 21 and according to the example on frame part 23. In the installed condition the guide rod 49, the frame part 23 and the grip part 21 form a unit relative to which breech part 37 can move between the initial position I and the retracted position III.

In the embodiment of the breech spring arrangement 25 illustrated here, the outer breech spring 47 and the inner breech spring 48 form a telescopic spring arrangement in order to achieve a compact configuration in longitudinal direction L. In modification to this, also one single breech spring would be sufficient. It is in addition possible to provide more than two breech springs 47, 48.

For supporting the outer breech spring 47 around the inner breech spring 48, a guide sleeve 53 is present, which surrounds a longitudinal section of guide section 52 and inner breech spring 48. In longitudinal direction L, guide sleeve 53 is shorter than guide section 52, so that the guide sleeve 53 can move along the guide section 52 in longitudinal direction L. On its back end, guide sleeve 53 has a back flange 54 extending radially outwardly on which the outer breech spring 47 is supported with its back end. With its front end opposed thereto in longitudinal direction L, outer breech spring 47 is supported on support part 38 of breech part 37.

The guide sleeve 53 has in addition a radially inwardly projecting front flange 55 on which the inner breech spring 48 is supported with its front end. The inner breech spring 48 is supported with its back end, which is opposed to the front end in longitudinal direction L, on the back stop 51 of guide rod 49. By means of the guide sleeve 53, outer breech spring 47 and inner breech spring 48 are thus effective between breech part 37 and frame part 23 or grip part 21 and according to the example are connected in series. As explained, the number of used breech springs may vary.

The function of the hand-held gun 20 described so far is subsequently explained with regard to FIGS. 8-11.

It is assumed that the breech part 37 is in the initial position I relative to grip part 21 and frame part 23, which is illustrated in FIG. 1. By means of the breech spring arrangement 25, a closure force is applied between breech part 37 on one hand and frame part 23 or grip part 21 on the other hand, which maintains breech part 37 in the initial position I without external force application.

In the initial position I the support part 38 of breech part 37 is arranged with longitudinal distance from buffer body 24 in longitudinal direction L, wherein this longitudinal distance exists or is present between stop surface 36 of buffer body 24 and the assigned counter-stop surface 40 of support part 38 (FIG. 1). It is now assumed that a shot is fired by means of the hand-held gun 20. The explosion of the cartridge in the chamber 46 applies a recoil force via a non-illustrated closure element of breech part 37 onto breech part 37 so that breech part 37 is accelerated backwards in longitudinal direction L relative to grip part 21 and frame part 23. Thereby support part 38 of breech part 37 moves along the guide section 52 of guide rod 49 and compresses the at least one breech spring 47, 48, i.e. according to the example the outer breech spring 47 as well as the inner breech spring 48 of breech spring arrangement 25. The support part 38 moves closer to the buffer body 24. In a partly compressed condition of the at least one breech spring 47, 48 of breech spring arrangement 25 the stop surface 36 of buffer body 24 and counter-stop surface 40 of support part 38 get into contact in the abutment position II, in which buffer body 24 is still in its elastically non-compressed—or for installation reasons only partly compressed—initial condition (FIG. 8). In the abutment position II, buffer body 24 is however not compressed in longitudinal direction L by means of breech part 37 or support part 38.

Figure 10:
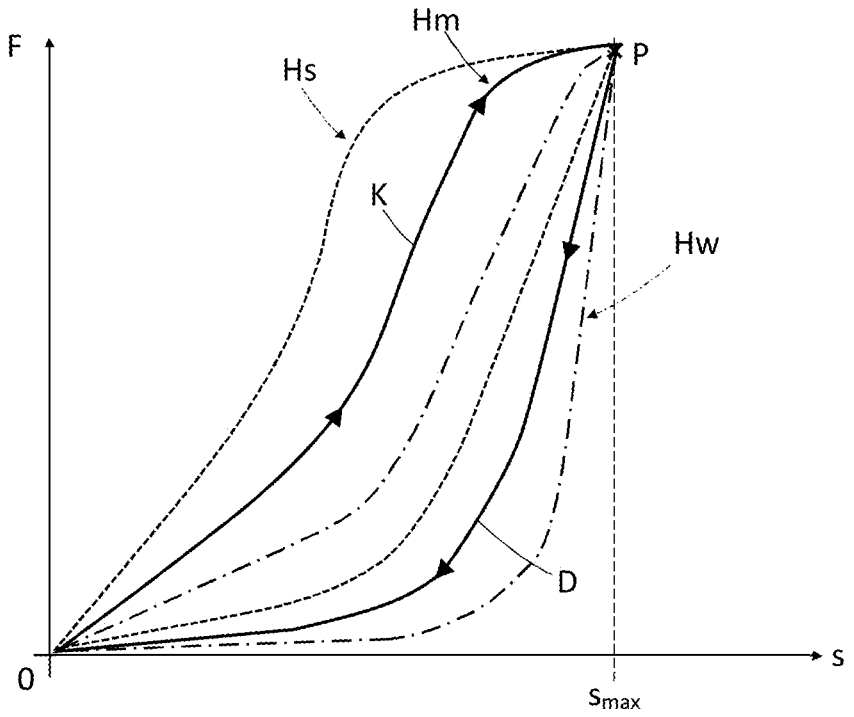

Due to a continued movement of breech part 37 in longitudinal direction L in backward direction out of the abutment position II (FIG. 8) in direction toward the retracted position III (FIG. 9), buffer body 24 or at least an elastically deformable part thereof is elastically compressed. The compression force F exerted by buffer body 24 in its compressed condition depending on the compression distance s is schematically illustrated in FIG. 10 based on different hysteresis curves Hs, Hm, Hw. The compression force F acts in addition to the closure force of breech spring arrangement 25 between breech part 37 on one hand and frame part 23 or grip part 21 on the other hand. Between the abutment position II and the retracted position III of breech part 37 the buffer body 24 is thus effective in addition to the breech springs 47, 48 and connected in parallel to the breech springs 47, 48 so-to-speak. The breech part 37 is supported in the movement area between the abutment position II and the retracted position III via the breech spring arrangement 25 and additionally via buffer body 24 on frame part 23 or grip part 21.

If breech part 37 is further moved backwards in longitudinal direction L from the abutment position II in the retracted position III and thereby compresses buffer body 24 elastically, also breech springs 47, 48 of breech spring arrangement 25 are further compressed. In the embodiment the windings of at least one of the two breech springs 47, 48 and according to the example the outer breech spring 47 get into contact, if the retracted position III is reached (FIG. 9). In this condition the outer breech spring 47 cannot be further compressed and therefore it forms a rigid block in the type of a sleeve, which cannot be further compressed in longitudinal direction. According to the example, the outer breech spring 47 defines the retracted position III in which a further relative movement of breech part 37 in longitudinal direction L backwardly relative to frame part 23 or grip part 21 is blocked.

In the retracted position III, support part 38 is supported via the outer breech spring 47, guide sleeve 53 and according to the example back flange 54 of guide sleeve 53 and via back stop 51 of guide rod 49 on frame part 23 and thus on grip part 21. Due to the dimensions in longitudinal direction L of the completely compressed outer breech spring 47, the maximum compression distance $s_{max}$ is predefined along which buffer body 24 is compressed (FIGS. 9 and 10) starting from its initial condition (abutment position II of breech part 37 relative to grip part 21).

Due to the compression force F as well as the closing force of breech spring arrangement 25, breech part 37 is subsequently moved starting from the retracted position III back into the initial position I.

As can be seen in FIG. 10, buffer body 24 comprises a hysteresis. The origin of the diagram illustrated in FIG. 10 illustrates the non-deformed or only slightly deformed initial condition of the buffer body 24. At point P the buffer body 24 is maximally elastically deformed or maximally compressed. The schematically illustrated hysteresis curves Hs, Hm, Hw describe a compression path K as well as a decompression path D, which is different from compression path K respectively. Along the compression path K from the initial condition (origin) up to the point P the resulting compression force F is larger than along the decompression path D from point P back to the origin or the initial condition in each of the individual hysteresis curves Hs, Hm, Hw. Dependent from the configuration and, for example, the shape and/or dimensioning of buffer body 24, the hysteresis curve or compression path K and decompression path D can obtain a desired progress, whereby the stiffness of the buffer body 24 can be predefined depending on the application so-to-speak. Accordingly, different hysteresis curves can be set by means of the configuration of the buffer body 24. In FIG. 10 only by way of example for illustration purposes three different hysteresis curves are shown: a hysteresis curve of medium stiffness Hm, characterizing a medium stiffness of buffer body 24 in longitudinal direction L; a hysteresis curve of higher stiffness Hs, characterizing a higher stiffness compared with the medium stiffness of buffer body 24 in longitudinal direction L; and a hysteresis curve of lower stiffness Hw, characterizing a lower stiffness compared with the medium stiffness of buffer body 24 in longitudinal direction L.

Figure 11:
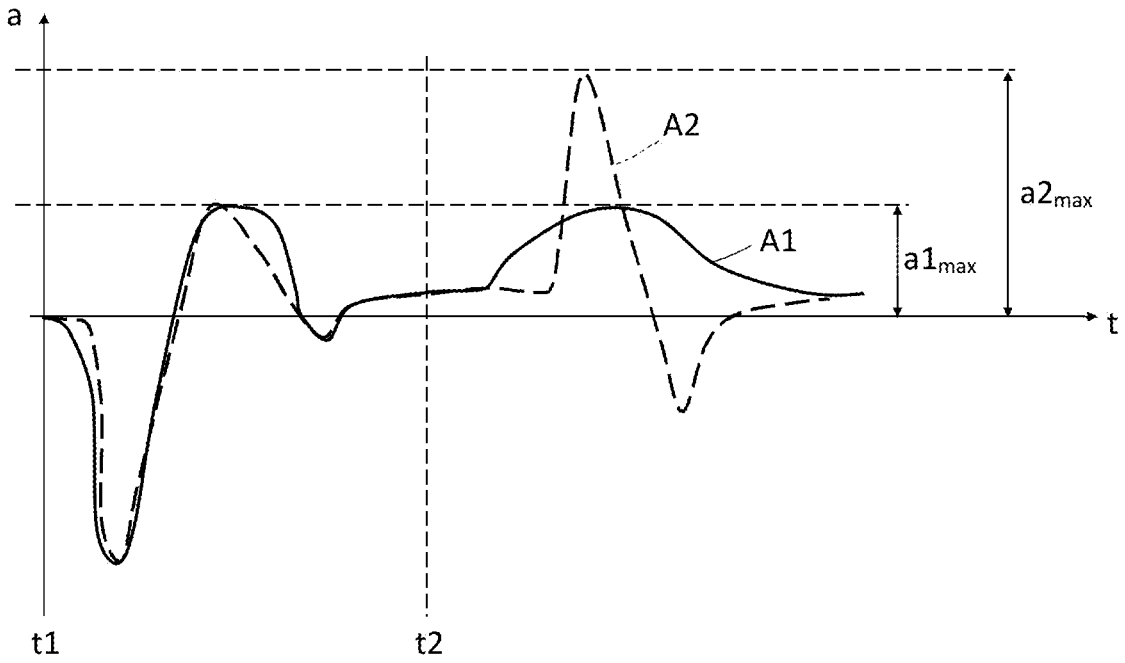
Figure 12:
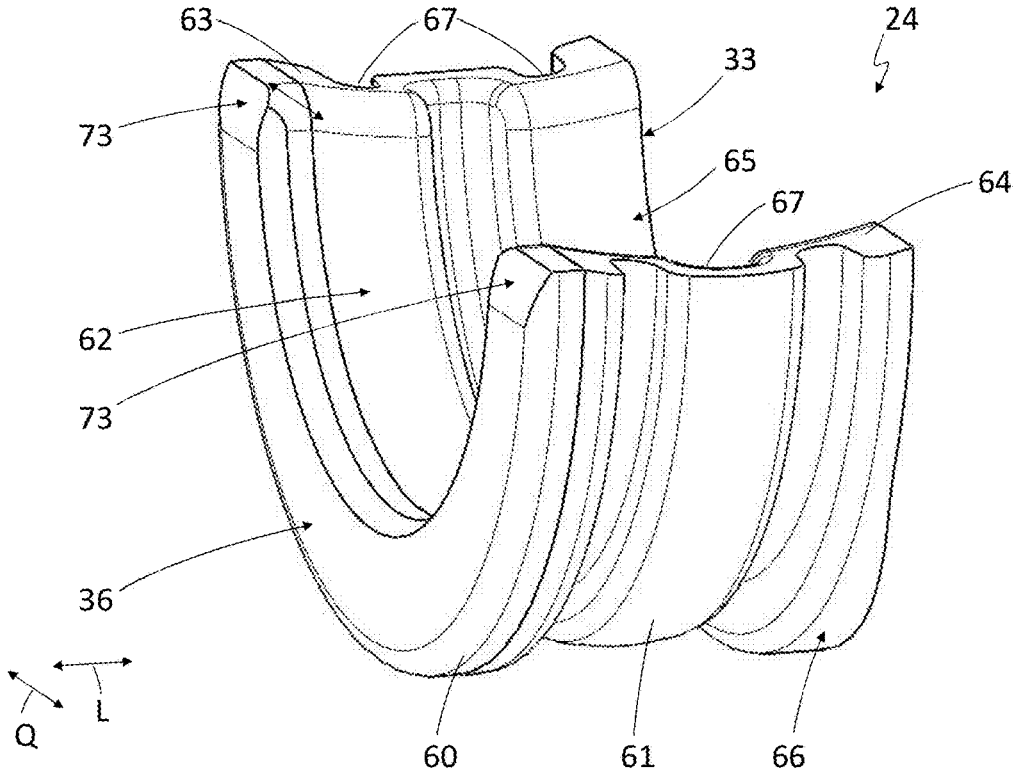
FIGS. 12-14 one embodiment of a buffer element respectively of the hand-held gun according to the present invention in different illustrations, FIGS. 15 and 16 a top view on an embodiment of a buffer body respectively having a modified geometry for modification of the stiffness in longitudinal direction compared with the buffer body according to FIGS. 12-14, FIG. 17 a schematic sectional illustration through an elastomer element of an embodiment of a buffer body in a sectional plane parallel to the longitudinal direction and FIG. 18 a perspective illustration of another embodiment of the buffer body.
Figure 13:
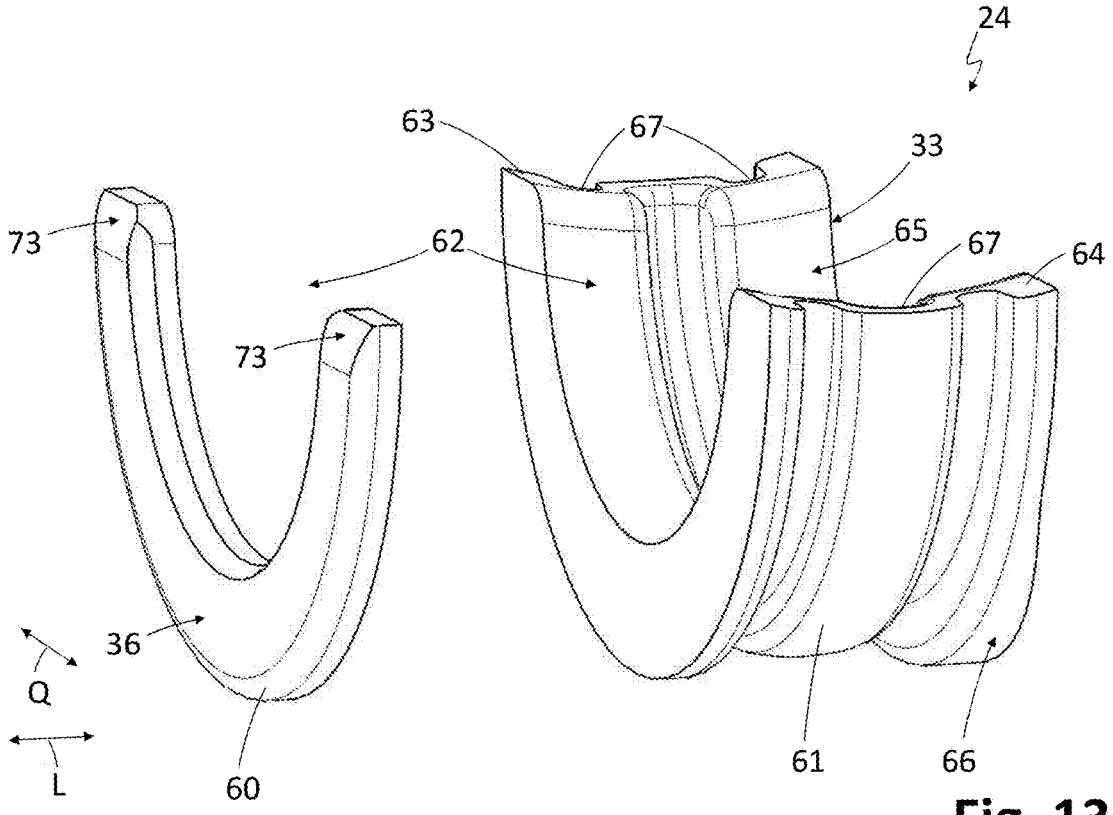

In FIG. 11 an acceleration a acting on the grip part 21 after firing is schematically illustrated depending on time t. A first acceleration curve A1 illustrates the acceleration a dependent from time t in the configuration of the hand-held gun 20 according to the invention, while the second acceleration curve A2 illustrates the acceleration a occurring in an exemplary hand-held gun 20 without the buffer body 24 according to the invention depending on time t.

At a first point in time t1 a shot is fired. During a first phase up to a second point in time t2 breech part 37 moves backwards without contact to buffer body 24 in longitudinal direction L. At a second point in time t2 the abutment position II illustrated in FIG. 8 is reached and buffer body 24 begins to apply a compression force F between grip part 21 and breech part 37 in addition to the closing force of breech spring arrangement 25. It is apparent that the maximum absolute value of acceleration a according to the first acceleration curve A1 is remarkably lower after the second point in time t2, due to the present buffer body 24 than the maximum absolute value of acceleration a occurring in a common hand-held gun 20 without additional buffer body 24 (second acceleration curve A2). The maximum absolute value of the acceleration $a1_{max}$ of first acceleration curve A1 occurring after the second point in time t2 can be remarkably reduced according to the invention relative to the maximum absolute value of the acceleration $a2_{max}$ of the second acceleration curve A2 (hand-held gun 20 without buffer body).

With reference, particularly to FIGS. 12-18, the configuration of buffer body 24 is explained in detail based on embodiments.

In the illustrated embodiment the buffer body 24 comprises a stop plate 60 and an elastomer element 61, which is elastically deformable in longitudinal direction L. With view in longitudinal direction L stop plate 60 is arranged in front of the elastomer element 61 and comprises the stop surface 36 of buffer body 24. On the back side opposed to the stop plate 60, the back surface 33 of buffer body 24 is present on the elastomer element 61.

In the preferred embodiment described here, buffer body 24 comprises only two components, namely stop plate 60 as well as elastomer element 61. It can therefore consist of only two different materials, namely a material of stop plate 60 that is not elastically deformable by the occurring forces and a material of elastomer element 61 elastically deformable in longitudinal direction. For example, a metallic alloy can be used as material for stop plate 60, e.g. a steel alloy. The elastomer can comprise natural rubber and/or synthetic rubber from an arbitrary group, e.g. Styrene-butadiene rubber (SBR), ethylene-propylene-diene rubber (EPDM), silicone rubber (SI), etc. The elastomer element 61 can be a massive, compact body having comparably low porosity or can be a porous foam body.

The stop plate 60 and the elastomer element 61 are non-releasably connected with one another by substance bond and/or by an adhesive joint. For example, the elastomer element 61 can be formed on the stop plate 60 during and due to the production of buffer body 24, e.g. by means of a molding process. The connection between the elastomer element 61 and stop plate 60 can be established during hardening of the elastomer material.

The buffer body 24 has a longitudinal opening 62 extending in longitudinal direction L entirely through buffer body 24. The breech spring arrangement 25 extends through the longitudinal opening 62. According to the example, longitudinal opening 62 is open to the top. Thereby, buffer body 24 has a trough-shaped or U-shaped form with view in longitudinal direction L or in cross-section orthogonal to the longitudinal direction L. It can extend starting from a right side end 63 in an arc-shaped and particularly circular arc-shaped manner toward a left side end 64 around an axis, which is orientated parallel to the longitudinal direction L. Between the right side end 63 and the left side end 64 buffer body 24 can comprise a constant cross-section (apart from tapers or chamfers directly adjoining the ends 63, 64). This cross-section can have a suitable generally arbitrary form or geometry according to the desired stiffness of the elastomer element 61 and thus buffer body 24.

The buffer body 24 has an inner side 65 limiting the longitudinal opening 62 and an outer side 66 facing away from the inner side 65. Due to the shaping of inner side 65 and/or outer side 66, a thickness of buffer body 24, particularly the elastomer element 61, can be measured orthogonal to an axis—around which the buffer body 24 curves from the right side end 63 to the left side end 64—extending parallel to the longitudinal direction L. This thickness of the elastomer element 61 can be constant in longitudinal direction L between stop plate 60 and back surface 33 or can vary, as in the preferred embodiment illustrated here.

As particularly apparent from FIGS. 12, 13, 18 and FIG. 4, the end surfaces provided on the right side end 63 and the left side end 64 are not straight with view in longitudinal direction, but are concavely domed. Starting from a center area of buffer body 24 in the longitudinal direction L, the height on the right side end 63 as well as the left side end 64 increases in longitudinal direction L toward the front and toward the back. Thereby a clearance for displacement of material of elastomer element 61 during compression of buffer body 24 is provided. It can be achieved that the compressed and thus deformed buffer body 24 or the deformed elastomer element 61 does not block movably supported parts, particularly not the movement of breech part 37.

In the preferred embodiment buffer body 24 and particularly elastomer element 61 comprises at least one and preferably multiple cavities 67. The cavities 67 serve to define the stiffness of elastomer element 61 in longitudinal direction L according to the application. Due to the number and/or the form and/or the size of the cavities 67, a desired hysteresis curve Hs, Hm, Hw with higher or lower stiffness can be set. By means of the cavities 67, in addition a temperature-dependent variation of the hysteresis curve Hs, Hm, Hw can be reduced.

In the embodiment illustrated in FIGS. 12-17 one single group having three cavities 67 is provided. FIG. 18 shows another embodiment having a longer buffer body 24 comprising more than three cavities 67 and according to the example, nine cavities 67, which are arranged in three identically configured groups of cavities 67. According to the example, cavities 67 are either open to the inner side 65 or to the outer side 66 and thus form groove-shaped cavities 67. The cavities can be grouped in a manner so that each group comprises at least one cavity open to the inner side 65 and at least one cavity open to the outer side 66. Within each group the cavities 67, which are open to the inner side 65 and which are open to the outer side 66, are arranged alternatingly in longitudinal direction L adjacent to one another. In this manner the elastomer element 61 obtains a shape having a meandering form or accordion-like or bellows-like form.

In the embodiment each group has three cavities 67. The number of cavities 67 of an individual group and/or the number of provided groups can vary.

The embodiment according to FIGS. 12-17 shows an elastomer element 61 that has one single longitudinal section having one single group of three cavities 67, according to the example. The embodiment shown in FIG. 18 has multiple and according to the example, three of such longitudinal sections, which respectively have the same geometry or shape. By lining up of multiple identical longitudinal sections of the elastomer element 61 and/or enlargement of the length of elastomer element 61, the stiffness of buffer body 24 in longitudinal direction can be reduced.

Each of the cavities 67 extends arc-shaped along the elastomer element 61 from the right side end 63 up to the left side end 64. The cavities 67 are open on the right side end 63 and on the left side end 64 according to the example. As explained, they are additionally or alternatively either open to the inner side 65 or to the outer side 66 and thus groove-shaped.

By defining the shape and/or the size and/or the number and/or the distance in longitudinal direction L of cavities 67, the stiffness of elastomer element 61 and thus buffer body 24 in longitudinal direction L can be defined depending on the application.

Figure 17:
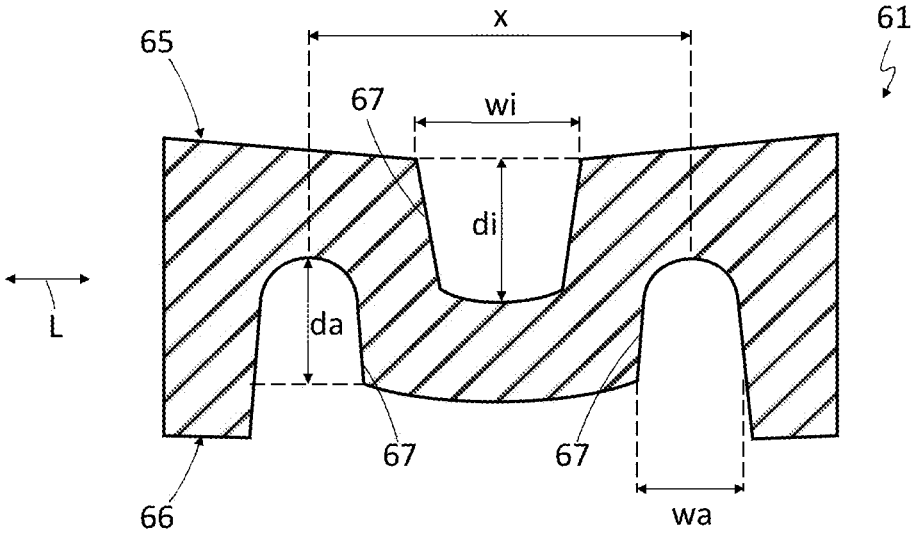
Figure 18:
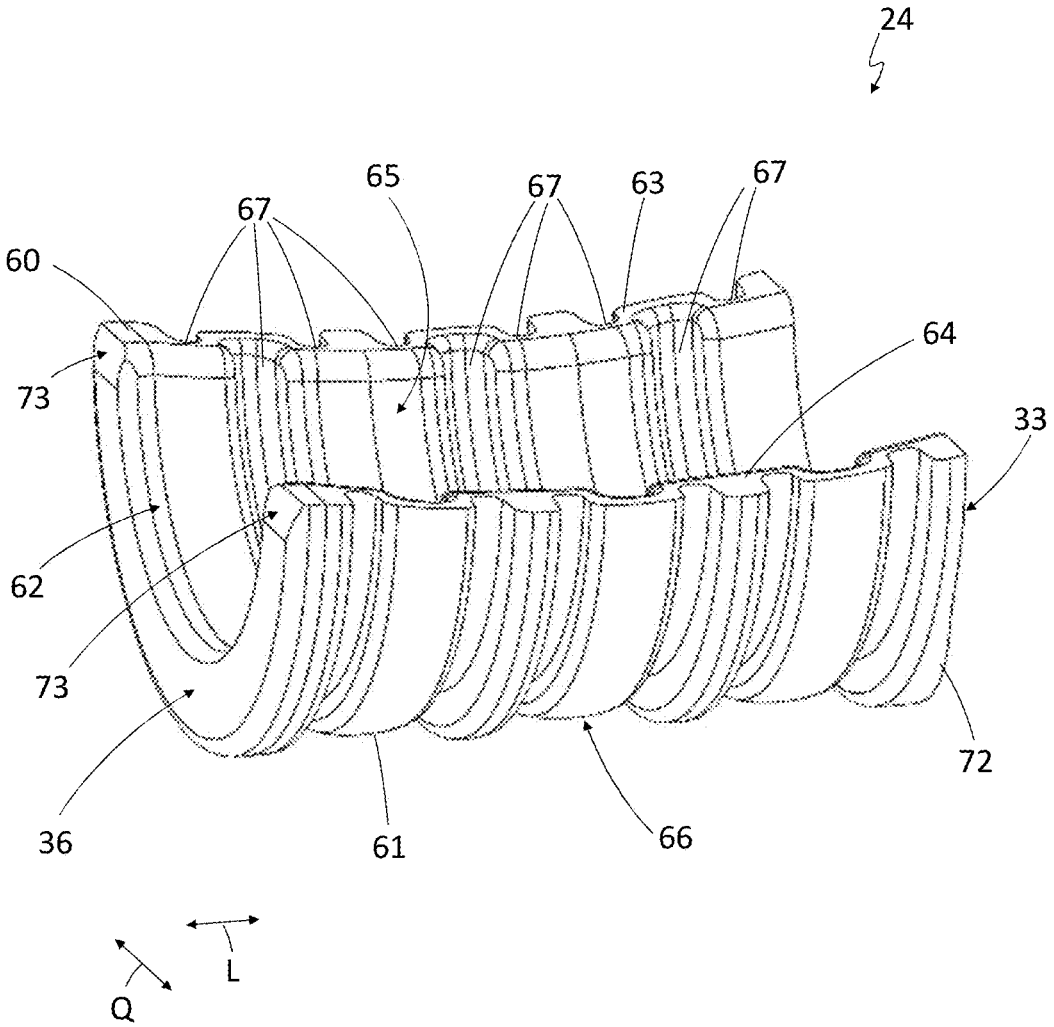

For determination of the stiffness different parameters of the form or geometry of the buffer body 24 and particularly the elastomer element 61 can be varied, as schematically illustrated based on FIG. 17. FIG. 17 shows a sectional image of the elastomer element 61 in a sectional plane parallel to the longitudinal direction L (e.g. orthogonal to the transverse direction Q) in a schematic principle illustration). The stiffness of the elastomer element 61 in longitudinal direction L can at least be varied or predefined by one or multiple of the following parameters:

- a depth di of the at least one cavity 67 open to the inner side 65;
- a depth da of at least one cavity 67 open to the outer side 66;
- a distance x between two directly adjacent cavities 67, which are open to the same side 65 or 66;
- a width wi in longitudinal direction L of at least one cavity 67 open to the inner side 65;
- a width wa in longitudinal direction L of at least one cavity 67 open to the outer side 66;
- a thickness of the elastomer element 61 measured in a sectional plane orthogonal to the inner side 65 and/or the outer side 66 through the elastomer element 61.

The width wi, wa and the depth di, da can be average values or maximum values for the widths wi, wa or depths di, da of the cavity 67. In addition or alternatively, also other parameters can be varied that define the geometry and the shape, for example.

Figure 14:
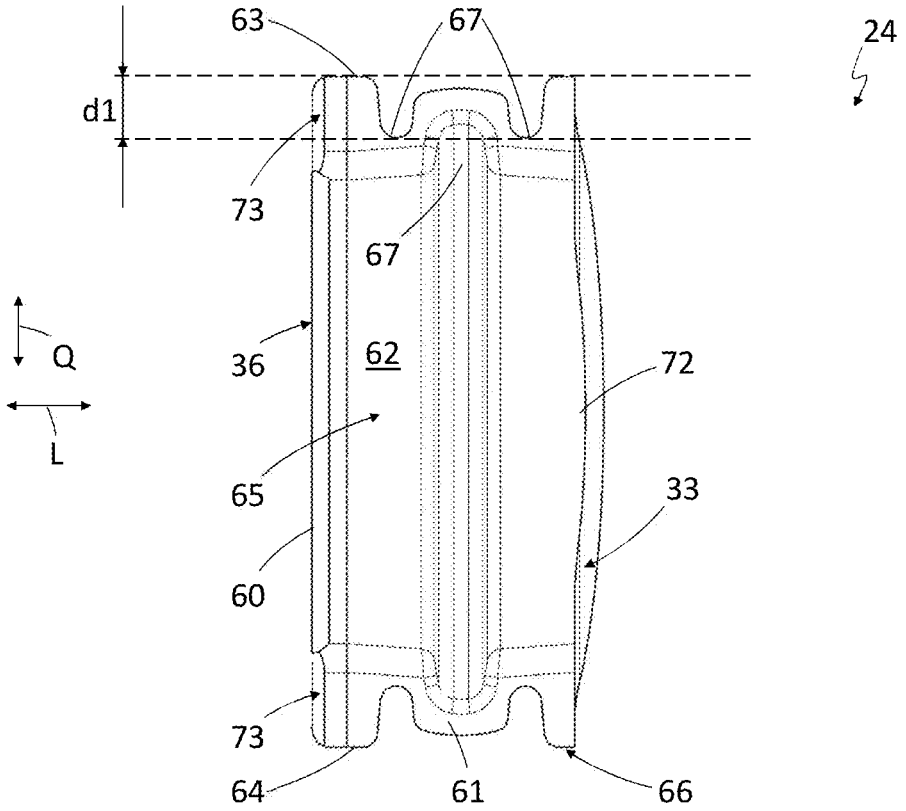
Figure 15:
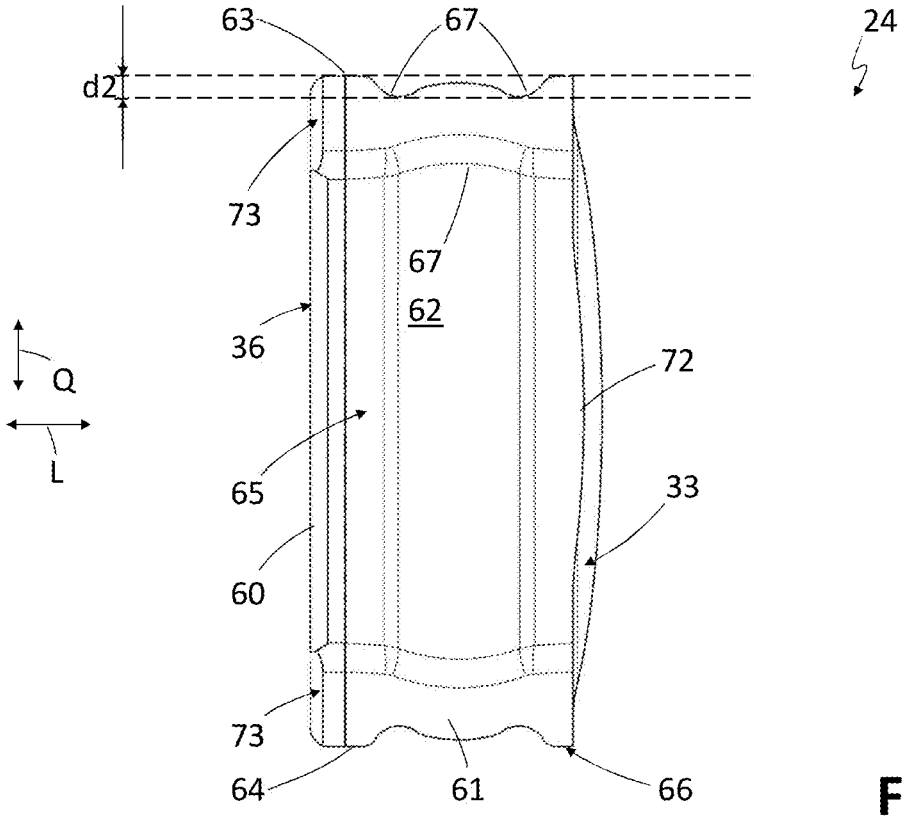
Figure 16:
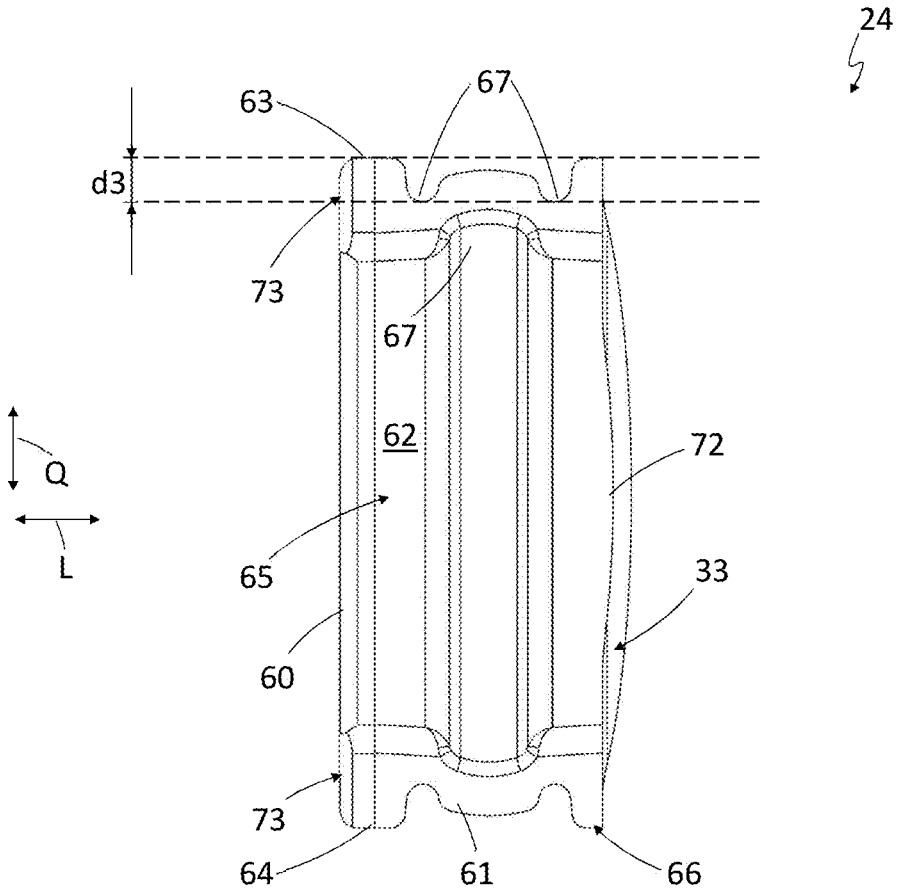

In FIGS. 14-16 three embodiments of the buffer body 24 are illustrated by way of example in which the cavities 67 have different depths with view orthogonal to the longitudinal direction. Relative to the outer side 66, the cavities 67 open to the outer side 66 have a maximum first depth d1 in the embodiment according to FIG. 14, a maximum second depth d2 in the embodiment according to FIG. 15, which is less than the first depth d1 and in the embodiment according to FIG. 16, a maximum third depth d3, which is less than the first depth d1, but larger than the second depth d2. In addition or as an alternative, the at least one cavity 67 open to the inner side 65 can vary in analog manner in the embodiments. Thereby the stiffness of buffer body 24 in longitudinal direction L is smaller in the embodiment according to FIG. 14 as in the embodiment according to FIG. 16 and is greater in the embodiment according to FIG. 15 than in the embodiment according to FIG. 16.

At this point it is indicated again that the geometry, the number and the spatial arrangement of the cavities 67 can vary and the illustration of the preferred embodiments is only exemplary. It is also possible to configure the elastomer element 61 of buffer body 24, so that the inner side 65 and/or the outer side 66 is free from cavities 67 and/or projections or does not comprise corrugations. In such an embodiment elastomer element 61 can comprise, for example, a rectangular or trapezoid-shaped cross-section area.

In order to avoid a relative movement of buffer body 24 to the top out of the holding space 27 relative to grip part 21, as an option a holding device 70 can be provided. By means of the holding device 70, for example, a continuous form-fit connection or at least a form-fit connection in time phases can be established between buffer body 24 and the grip part 21 and/or the frame part 23 and/or the breech part 37.

Figure 4:
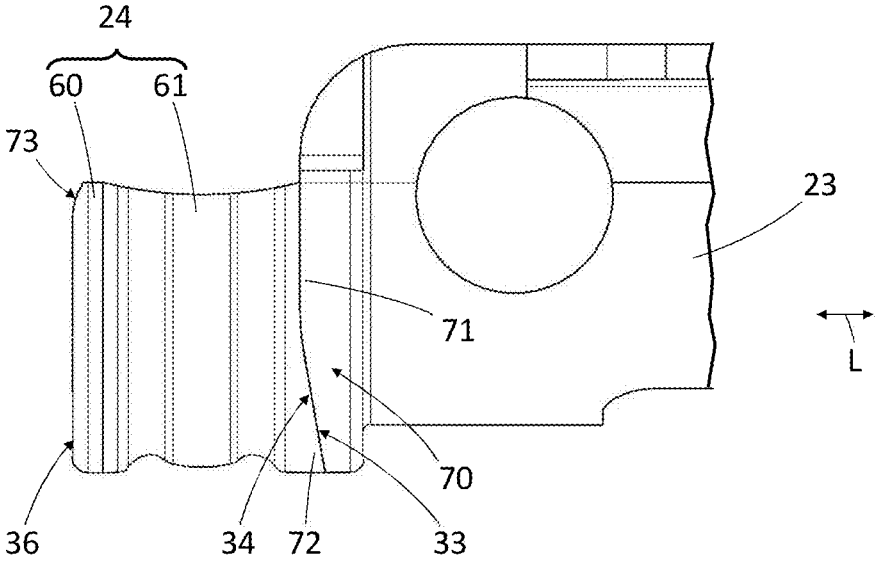
Figure 5:
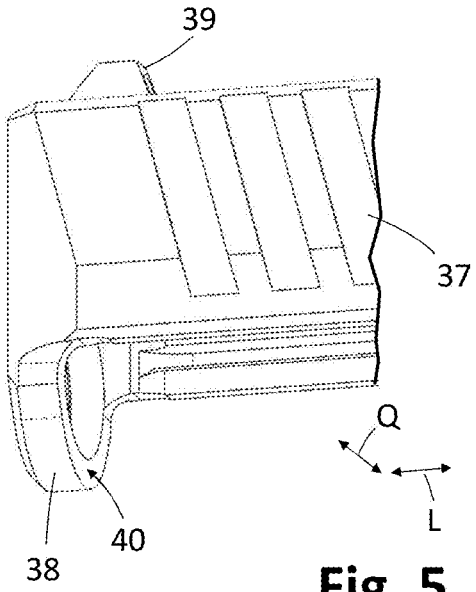
Figure 6:
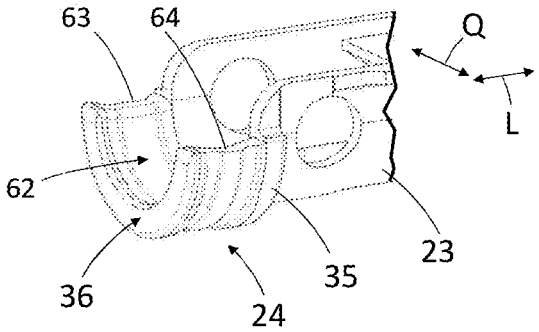
Figure 7:
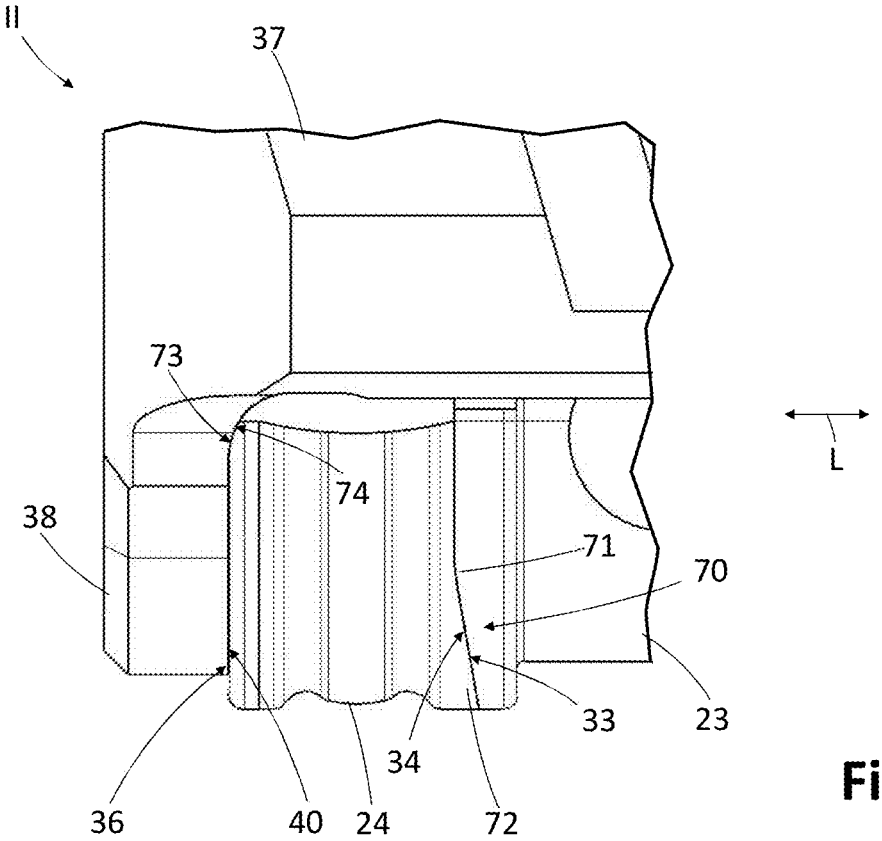

For this purpose, holding device 70 can comprise a safety section or safety projection 71, which extends over a holding section 72 on buffer body 24, as exemplarily illustrated in FIG. 4. For forming the holding section 72, the length of increases in the area of its back surface 33 with view from top to bottom. According to the example, on frame part 23 a safety section or safety projection 71 is formed, which extends over this holding section 72 of buffer body 24, i.e. the safety section or safety projection 71 is arranged above the holding section 72 in direction to the top and is preferably continuously in abutment with holding section 72.

The part of the back surface 33 provided on holding section 72 can be inclined under an angle relative to the longitudinal direction, which is different from a right angle. The part of the back surface 33 adjoining the right side end 63 and the left side end 64 is preferably orientated orthogonal to the longitudinal direction L. Therefore, the back surface 33 of buffer body 24 has a bent or angled location at the transition to the holding section 72. The abutment surface 34 of frame part 23 matches the form of the back surface 33, so that a continuous two-dimensional contact between the back surface 33 and the abutment surface 34 is achieved.

In addition or as an alternative, the safety section or safety projection 71 could also be provided on the grip part 21. In addition or as an alternative, it is also possible to arrange the safety section or safety projection 71 of holding device 70 at any other location of frame part 23 or grip part 21 at which it at least partly extends over buffer body 24 and can secure it thereby against an upward movement. For example, the at least one safety projection 71 could be realized in form of a pin or mandrel, which engages into a respective safety depression (e.g. safety hole) on the buffer body 24.

In the embodiment in addition, a holding section 72 comprising a safety surface 73 on the two ends of stop surface 36 and particularly at their upper ends is part of the holding device 70, as particularly apparent from FIGS. 4, 7, 12, 13 and 18. The safety surface 73 can be a planar surface or a curved surface. Preferably the safety surface 73 is convexly curved and can have a constant radius of curvature around an axis extending parallel to the transverse direction Q. In any case, safety surface 73 does not extend entirely orthogonal to the longitudinal direction L.

On the support part 38 a surface section 74 is provided on a safety section or a safety projection 71, the orientation and geometry of which can substantially correspond to the safety surface 73 or safety surfaces 73 of buffer body 24. In the movement area of breech part 37 from the abutment position II to the retracted position III, the surface section 74 abuts against the at least one safety surface 73 of buffer body 24 and maintains buffer body 24 in this manner inside holding space 27 or urges buffer body 24 downward to the bottom 29 of holding part 22.

In the embodiment according to the invention, the buffer body 24 is secured against a movement in upward direction by means of holding device 70 in the area of its front side by breech part 37 or its support part 38 and in the area of its back side by frame part 23. In doing so, it is avoided that buffer body 24 carries out an undesired upward compensation movement, but rather compresses in a defined manner in longitudinal direction L, so that the desired compression force F depending on the compression distance s is achieved.

The surface section 74 of support part 38 can project over buffer body 24 and in the embodiment stop plate 60 in the area of safety surface 73 and therefore also forms a safety projection 71, wherein the area of buffer body 24 and according to the example, stop plate 60 provided with safety surface 73 forms a holding section 72 of buffer body 24. Different to the safety projection 71 of frame part 23, support part 38 of breech part 37 extends over buffer body 24 only in a movement area of breech part 37 relative to the grip part 21 from the abutment position II to the retracted position III, but however not if breech part 37 is located between abutment position II and the initial position I. The securing effect against movement to the top of buffer body 24 by means of breech part 37 or support part 38 occurs in time phases only, if buffer body 24 is in fact in an at least partly compressed condition.

The invention refers to a hand-held gun 20 having a grip part 21 and a breech part 37 movably supported in longitudinal direction on grip part 21. A breech spring arrangement 25 urges breech part 37 in its initial position I relative to grip part 21. For this purpose, breech spring arrangement 25 is supported directly or indirectly between breech part 37 and grip part 21. Starting from the initial position I, breech part 37 can move against the closing force of breech spring arrangement 25 into an abutment position II in which it abuts against a buffer body 24. Starting from the abutment position II, breech part 37 can be moved under elastic compression of buffer body 24 in longitudinal direction L into a retracted position III. In the movement area between the abutment position II and the retracted position III, a compression force F of the preferably in longitudinal direction L and particularly exclusively in longitudinal direction L compressed buffer body 24 applies in addition to the closing force of the breech spring arrangement 25 between the grip part 21 and the breech part 37.

LIST OF REFERENCE SIGNS

20 hand-held gun
21 grip part
22 holding part
23 frame part
24 buffer body
25 breech spring arrangement
26 sidewall of support part
27 holding space
28 holding depression
29 bottom of support part
33 back surface of buffer body
34 abutment surface of frame part
35 front part of frame part
36 stop surface of buffer body
37 breech part
38 support part
39 front sight
40 counter-stop surface of support part
45 barrel
46 chamber
47 outer breech spring
48 inner breech spring
49 guide rod
50 front stop
51 back stop
52 guide section
53 guide sleeve
54 back flange
55 front flange
60 stop plate
61 elastomer element
62 longitudinal opening
63 right side end of buffer body
64 left side end of buffer body
65 inner side of buffer body
66 outer side of buffer body
67 cavity
70 holding device
71 safety projection
72 holding section
73 safety surface
74 surface section
I initial position
II abutment position
III retracted position
a acceleration
A1 first acceleration curve
$a1_{max}$ maximum absolute value of acceleration of first acceleration curve
A2 second acceleration curve
$a2_{max}$ maximum absolute value of acceleration of second acceleration curve
D decompression path
d1 first depth
d2 second depth
d3 third depth
da depth of cavity open to outer side
di depth of cavity open to inner side
F compression force
K compression path
L longitudinal direction
P point
Q transverse direction
s compression distance
$s_{max}$ maximum compression distance
t time
t1 first point in time
t2 second point in time
wa width of cavity open to outer side
wi width of cavity open to inner side
x distance between two cavities in longitudinal direction open to outer side or inner side in each case

The invention claimed is:

1. A hand-held gun (20) comprising:
a grip part (21);
a breech part (37) movably supported on the grip part (21) in a longitudinal direction (L) between an initial position (I) and a retracted position (III);
a breech spring arrangement (25) configured to urge the breech part (37) in the initial position (I); and
an elastically deformable buffer body (24) arranged on the grip part (21), wherein a longitudinal distance is present in the longitudinal direction (L) between the buffer body (24) and the breech part (37) in the initial position (I) of the breech part (37), and wherein the breech part (37) elastically compresses the buffer body (24) in the retracted position (III) of the breech part (37);
wherein the buffer body (24) is u-shaped and defines a longitudinal opening (62) through which the breech spring arrangement (25) extends at least partly, wherein the longitudinal opening (62) is open in a vertical direction orthogonal to the longitudinal direction.

2. The hand-held gun according to claim 1, wherein a frame part (23) is arranged on the grip part (21), wherein the buffer body (24) is indirectly supported on the grip part (21) via the frame part (23).

3. The hand-held gun according to claim 1, wherein the buffer body (24) comprises a rigid stop plate (60) for the breech part (37) and an elastically deformable elastomer element (61).

4. The hand-held gun according to claim 1, wherein the breech spring arrangement (25) is supported with one end thereof indirectly or directly on the grip part (21) and with an other end indirectly or directly on the breech part (37).

5. The hand-held gun according to claim 1, wherein the breech spring arrangement (25) comprises at least one breech spring (47, 48).

6. The hand-held gun according to claim 5, wherein the at least one breech spring (47, 48) is configured to limit the elastic compression of the buffer body (24) in longitudinal direction (L).

7. The hand-held gun according to claim 1, further comprising a holder (70) configured to establish a form-fit and/or force-fit connection between the buffer body (24) and the grip part (21) and/or a frame part (23) arranged on the grip part (21).

8. The hand-held gun according to claim 7, wherein the holder (70) is configured to counteract a relative movement of the buffer body (24) relative to the grip part (21) and/or the frame part (23) in an upward direction transverse to the longitudinal direction.

9. The hand-held gun according to claim 7, wherein the holder (70) comprises at least one safety projection (71) disposed on the grip part (21) and/or the frame part (23) and/or the breech part (37), wherein the at least one safety projection (71) extends in the longitudinal direction and over a holding section (72) of the buffer body (24).

10. The hand-held gun according to claim 1, wherein the buffer body (24) comprises at least one cavity (67) which forms a clearance in a non-compressed initial condition of the buffer body (24), wherein the clearance is configured to be compressed in the longitudinal direction (L).

11. The hand-held gun according to claim 10, wherein the at least one cavity (67) extends parallel to a transverse plane, wherein the transverse plane is oriented orthogonal to the longitudinal direction (L).

12. The hand-held gun according to claim 10, wherein the at least one cavity (67) is groove-shaped.

13. The hand-held gun according to claim 10, wherein the at least one cavity (67) is open to an outer side (66) or to an inner side (65) of the buffer body (24).

14. The hand-held gun according to claim 10, wherein the at least one cavity comprises multiple cavities (67) arranged with distance between one another in the longitudinal direction (L).

15. A hand-held gun (20) comprising:

a grip part (21);

a breech part (37) movably supported on the grip part (21) in a longitudinal direction (L) between an initial position (I) and a retracted position (III);

a breech spring arrangement (25) configured to urge the breech part (37) in the initial position (I); and an elastically deformable buffer body (24) arranged on the grip part (21), wherein a longitudinal distance is present in the longitudinal direction (L) between the buffer body (24) and the breech part (37) in the initial position (I) of the breech part (37), and wherein the breech part (37) elastically compresses the buffer body (24) in the retracted position (III) of the breech part (37);

wherein the buffer body (24) comprises at least one cavity (67) which forms a clearance in a non-compressed initial condition of the buffer body (24), wherein the clearance is configured to be compressed in the longitudinal direction (L);

wherein the at least one cavity comprises multiple cavities (67) arranged with distance between one another in the longitudinal direction (L);

wherein the multiple cavities (67) form one or more groups and the cavities (67) of the multiple cavities within each group are alternatingly open to an outer side (66) and to an inner side (65) of the buffer body (24).

* * * * *